United States Patent [19]

Prewer et al.

[11] Patent Number: 4,986,040

[45] Date of Patent: Jan. 22, 1991

[54] MODULAR ELEVATOR SHAFT

[75] Inventors: John R. Prewer, NrSittingbourne; Leslie B. Power, Epsom, both of England

[73] Assignee: Inventio AG, Switzerland

[21] Appl. No.: 451,432

[22] Filed: Dec. 15, 1989

[30] Foreign Application Priority Data

Dec. 19, 1988 [GB] United Kingdom ..... 8829603

[51] Int. Cl.[5] ..... B66B 9/00; E04F 15/14; E04H 1/00

[52] U.S. Cl. ..... 52/79.1; 52/79.5; 52/79.14; 52/236.5; 52/396; 187/1 R

[58] Field of Search ..... 52/79.1, 79.5, 79.14, 52/403, 395, 396, 236.9; 405/109, 112, 135, 152; 187/1 R

[56] References Cited

U.S. PATENT DOCUMENTS

| | | | |
|---|---|---|---|
| 2,074,592 | 3/1937 | Rowell | 52/396 X |
| 2,363,429 | 11/1944 | Lowry | 52/396 |
| 3,110,907 | 11/1963 | King . | |
| 3,382,631 | 5/1968 | Halpern | 52/30 |
| 3,662,506 | 5/1972 | Dillon | 52/262 X |
| 3,742,666 | 7/1973 | Antoniou | 52/79.1 X |
| 3,818,660 | 6/1974 | Dillon | 52/79.14 X |
| 4,058,947 | 11/1977 | Earle | 52/396 |
| 4,231,148 | 11/1980 | Harding | 29/469 |
| 4,533,278 | 8/1985 | Corsover | 52/396 X |
| 4,614,067 | 9/1986 | Matsubara | 52/403 X |
| 4,866,898 | 9/1989 | LaRoche | 52/396 |

FOREIGN PATENT DOCUMENTS

| | | | |
|---|---|---|---|
| 496488 | 10/1975 | Australia | 52/79.1 |
| 1683086 | 1/1971 | Fed. Rep. of Germany . | |
| 2187663 | 1/1974 | France . | |
| 90202 | 5/1972 | German Democratic Rep. . | |
| 398048 | 8/1965 | Switzerland . | |
| 2015615 | 9/1979 | United Kingdom . | |
| 8806063 | 3/1989 | United Kingdom . | |

*Primary Examiner*—David A. Scherbel
*Assistant Examiner*—Deborah McGann Ripley
*Attorney, Agent, or Firm*—Marshall & Melhorn

[57] ABSTRACT

A prefabricated elevator shaft includes a stack of self-supporting prefabricated shaft modules whereby upper shaft modules are supported on lower modules. Each module is of rectangular cross section and vertically spaced portions at each corner define a void between two adjacent modules. The voids are filled with a resin which, after joining together, forms a solid bed supporting the upper module in all directions. On the upper module, screw jacks extend into engagement with the lower module for vertical adjustment. On the lower module, removable guide shafts extend vertically and engage corresponding apertures in the upper module to locate the modules horizontally relative to one another during assembly of a elevator shaft. When the modules are satisfactorily located, the guide shafts can be removed and replaced with bolts to secure the upper module on the lower module.

20 Claims, 4 Drawing Sheets

MODULAR ELEVATOR SHAFT

BACKGROUND OF THE INVENTION

This invention relates to elevators in general and, in particular, to elevator shaft construction.

In United Kingdom patent application No. 8905898.6, there is described a self-supporting, modular elevator shaft comprising a stack of self-supporting, prefabricated shaft modules whereby upper shaft modules are supported on lower modules.

SUMMARY OF THE INVENTION

The present invention concerns an elevator shaft formed from a stack of separate, self-supporting, prefabricated shaft modules, each module having a structural strength sufficient to support the module or modules above. Corner supports are provided on the adjacent modules to define a void between vertically spaced portions of the modules. The void is filled with a structural resin in liquid or plastic form which on setting forms a solid bed in resin material for supporting the vertically spaced upper module on the adjacent lower module. Thus, a plurality of the shaft modules can be rapidly assembled as an elevator shaft with beds of resin disposed at spaced locations between the adjacent modules.

Typically, the prefabricated shaft modules are of rectangular transverse cross section, wherein means are provided at each corner of the rectangle for providing the voids such that, on filling of the voids with structural resin, the upper module is supported on the lower module in four regions. This construction provides sufficient support for an upper elevator shaft module on a lower elevator shaft module, the regions of support being limited to the corners of the elevator shaft modules, thereby minimizing the quantity of resin required to be provided to support the structure. Conveniently, voids can extend to either side of the apex of the corner of the rectangle at which each void is located, and each void defining means can include a pair of spaced horizontal surfaces disposed respectively on the upper edge of the lower shaft module and the lower edge of the upper shaft module, inner, outer and end barrier walls of the void being provided on the upper edge of the lower module.

The inner barrier wall of the void includes an upstanding plate secured on the inner surface of the upper end of the lower elevator shaft module and projecting above the upper edge of the module, an upper portion of the plate being inclined. The outer and end barrier walls of the void include upstanding walls of compressible foam disposed on the upper edge of the lower shaft module and on the inclined portion of the plate to define the void.

The elevator shaft can advantageously include jacking means to permit "plumbing" of an upper shaft module and an adjacent lower shaft module relative to one another. Preferably, the jacking means is disposed on the upper shaft module and is arranged to engage the lower shaft module. The jacking means can comprise a plurality of screw jacks disposed between an upper shaft module and an adjacent lower shaft module, there being a sufficient number of the screw jacks to permit adjustment of the relative orientation of the two modules in two mutually perpendicular planes parallel to the longitudinal axis of the elevator shaft and further to permit adjustment of the spacing between the adjacent modules.

The screw jacks each can include a nut secured above an aperture in a lower, horizontal flange surface of an upper shaft module and having threaded therein a bolt passing through the aperture the free end of which bolt contacts the horizontal surface on the upper edge of an adjacent lower shaft module. Tightening and loosening of the bolt serves to raise and lower the upper shaft module on the lower shaft module.

Guide means can be provided to permit locating an upper and a lower shaft module relative to one another during assembly of such an elevator shaft. Conveniently, the guide means can include a removable guide extending vertically from the lower module, the guide being engageable with a corresponding aperture formed in the upper module to locate the modules relative to one another. The removable guide can include a vertical shaft the free end of which tapers and is engageable with the aperture formed in the upper module, a portion of the shaft having a diameter smaller than the diameter of the aperture by a predetermined amount being engageable with the aperture to permit positioning of the modules relative to one another to within a predetermined tolerance on insertion of the shaft into the aperture An advantage of this arrangement is that, during assembly of the elevator shaft, the guide member can be provided to locate adjacent modules and, when the modules are satisfactorily located, the guide member can be removed and replaced with a bolt to secure the upper shaft module on the lower shaft module.

A horizontal flange extends outwardly about the upper edge of an adjacent lower shaft module similar to the horizontal flange about the lower edge of the upper module. The two flanges, on assembly of the elevator shaft, are aligned with one another and spaced from one another by the region of resin. The space between the flanges unsupported by the resin is at least partly filled by a compressible sealing strip aligned with the longitudinal axes of the horizontal flanges.

The modular elevator shaft further includes a plurality of anchoring means secured, on assembly of the elevator shaft, between a shaft module and a structure defining a well or aperture in a floor in which the elevator shaft stands to restrain transverse movement of the shaft module.

The modular elevator shaft also includes fire- and smokeproofing means encircling the shaft at the level of each floor of the building in which the shaft stands. The fire- and smokeproofing means includes a Z-section retainer plate the upper, horizontal member of which extends outwardly of the shaft and rests on the floor of the building and the lower, horizontal member of which extends inwardly to intersect the elevator shaft, thereby defining a channel encircling the elevator shaft to receive a fire- and smokeproof substance.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
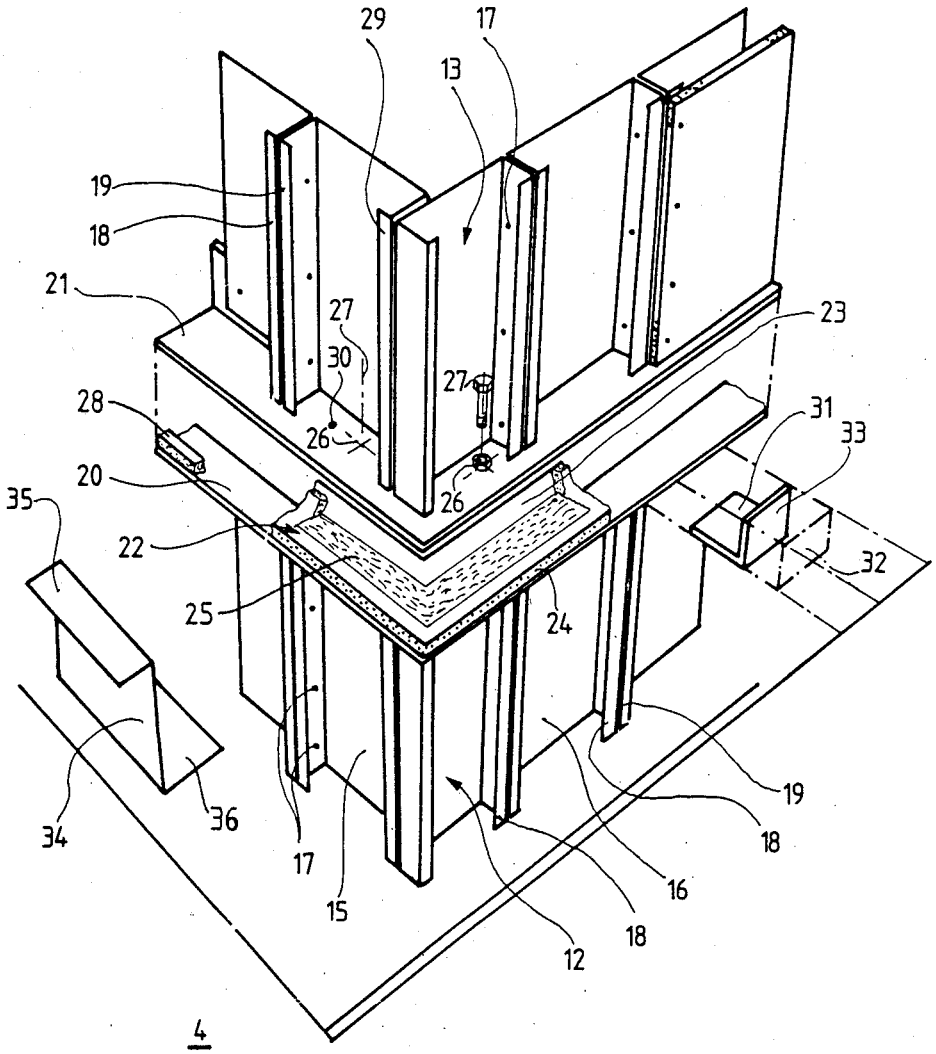
FIG. 1 is an exterior perspective, partially exploded and sectioned, view of a corner of an elevator shaft according to the present invention.
Figure 2:
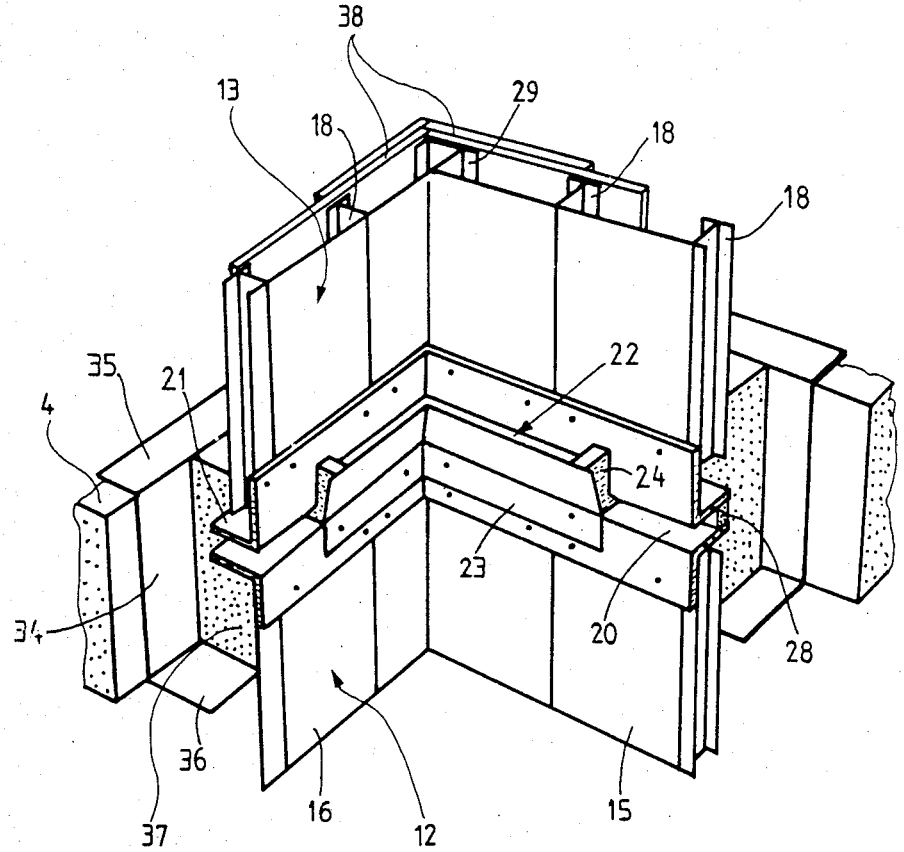
FIG. 2 is an interior perspective, partially sectioned view of the elevator shaft corner of FIG. 1 with the component parts assembled.
Figure 3:
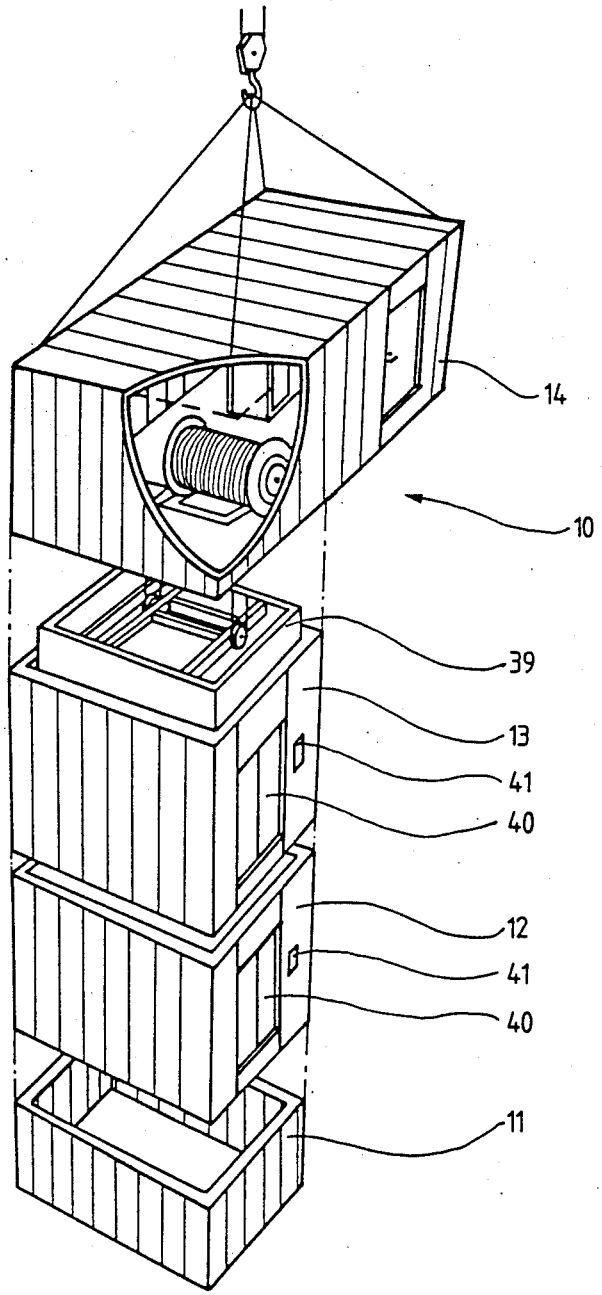
FIG. 3 is a perspective view of an elevator shaft according to the present invention with the modules spaced apart for clarity.

Referring to FIGS. 1 through 3, there is shown a prefabricated, self-supporting elevator shaft 10 including as shown, a stack of four self-supporting prefabricated shaft modules 11, 12, 13 and 14. FIGS. 1 and 2 show a corner of the joint between the adjacent modules 12 and 13. The joint is arranged to lie approximately at the level of a floor of the building in which the elevator shaft stands, and a concrete floor slab 4 having an aperture for the elevator shaft is visible in FIGS. 1 and 2.

Each elevator shaft module is rectangular in cross section, the cross sections of adjacent modules conforming with each other in the vicinity of the joints as herein described. Accordingly, the lower shaft module 12 has four vertical side walls, of which two 15 and 16 are visible in FIGS. 1 and 2 Each side wall is made up of a series of galvanized steel lipped channel sections secured to one another by rivets 17. Alternatively, bolts or other securing means can be used. The channel sections are arranged to present a series of vertical ribs 18 on the exterior of the elevator shaft while the interior of the shaft is generally flat walled, as shown in FIG. 2. Adjacent channel lips forming the ribs 18 have a silicone based joint sealant 19 inserted therebetween.

The construction of the walls of the upper shaft module 13 is similar to that of the lower shaft module 12. The upper edge of the lower shaft module 12 has an outwardly extending, encircling, horizontal flange 20 and a corresponding flange 21 is formed on the lower edge of the upper shaft module 13. When the modules are assembled as an elevator shaft, the two flanges 20 and 21 are aligned and lie adjacent one another, but they are spaced from one another by a resin filled corner support 22. The support 22 is representative of a further three such corner supports disposed on the remaining corners of the joint.

The corner support 22 has an upstanding, inner weir plate 23 extending above the level of the flange 20 through 90° and secured on the inner wall of the elevator shaft module 12. A length of compressible foam joint sealant 24 in strip form is secured on each of two inclined portions of the weir plate 23 and interconnects the two inclined portions via a path enclosing an L-shaped region defined on the surface of the flange 20. The sealant strip 24 forms, with the flange 20 and the inclined portion of the weir plate 23, a void as a trough to receive an epoxy resin 25 during assembly of the elevator shaft 10. When assembled the joint supports the upper shaft module 13 on the lower shaft module 12 via the region of resin 25, and the two shaft modules do not contact one another.

As shown in FIG. 1, a nut 26 welded over an aperture formed in the flange 21 on each side of the corner receives a threaded bolt 27 which acts as a screw jack to level and plumb the upper shaft module 13 on the lower shaft module 12 by virtue of contact between the lower free end of the bolt 27 and the flange 20. However this contact is only significantly load-bearing during assembly of the joint since once the resin 25 has been poured, it substantially supports the load at the joint.

On assembly of the joint, the resin is poured through an input aperture obscured by the lip of a corner channel section 29 in FIG. 1, and a weep hole 30 serves to permit escape of air as the trough defined by the sealing strip 24, the flange 20 and the weir plate 23 fills with resin. A further strip 28 of compressible foam joint sealant is secured around the outer periphery of the flanges 20 and 21 sealing the void therebetween from corner to corner.

The shaft modules are restrained against axial movement by a series of anchoring brackets, such as a bracket 31, distributed around the module and rigidly secured to the shaft module 12 adjacent the concrete floor slab 4. As shown in FIG. 1, a neoprene acoustic isolating pad 32 is inserted between a vertical face 33 of the anchoring bracket 31 and the concrete slab 4.

The joint is secured against fire and smoke passing from one floor of the building to another by a fire pack consisting of a Z-section fire pack retainer 34 having an upper, outwardly extending horizontal flange 35 resting on an upper surface of the floor slab 4 and a lower, inwardly extending horizontal flange 36 contacting the outer wall of the elevator shaft 10. A fireproof material, such as a loose-fill dry material 37, fills the channel encircling the elevator shaft 10 defined by the retainer 34 and the wall of the module 12 as shown in FIG. 2. The fire pack retainer 34 and elevator shaft outer wall can alternatively act as shuttering for a concrete fill used as a fireproofing layer.

The outer wall of the elevator shaft 10 can be clad with, for example, one or more layers 38 of plasterboard screwed to the ribs 18. Such cladding assists in the seal between the fire pack retainer 34 and the elevator shaft 10 thereby retaining a loose fill fireproof material in place, improving the sound insulation of the elevator shaft 10 and providing an easily decorated surface in the building in which the elevator shaft 10 is installed.

FIG. 3 shows three types of prefabricated elevator shaft modules. A pit module 11 is located below a stack of shaft modules 12 and 13 and has a joint as described above on each upper corner thereof. A prefabricated elevator motor room module 14 is secured at the top of the stack and includes all the motors and cables necessary for operation of the elevator. A prefabricated elevator car 39 is also included in the fully assembled elevator shaft 10, and the shaft modules such as 12 and 13 have elevator doors 40, control panels 41 and the other apparatus necessary for operation of the elevator when assembled.

Figure 5:
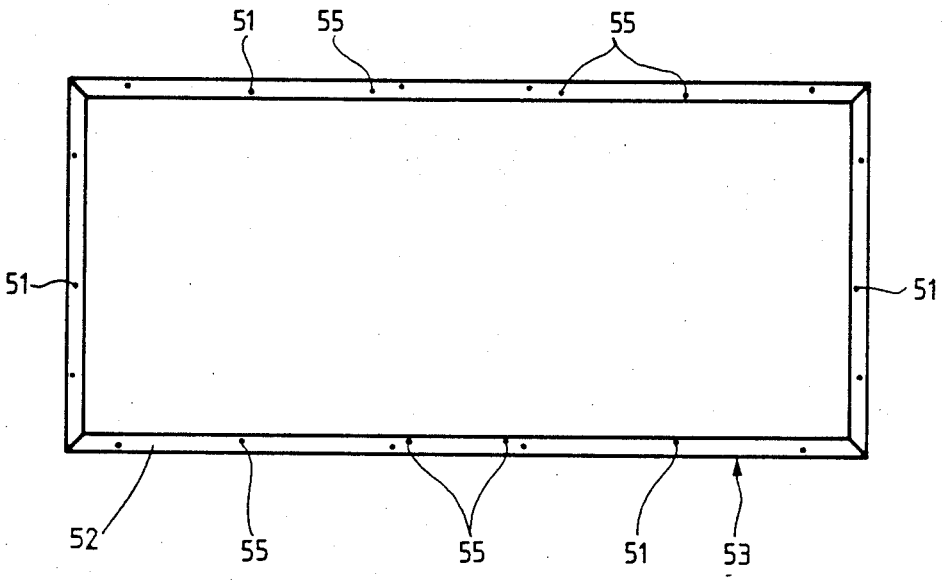
FIG. 5 is a top plan view of an upper surface of a lower elevator shaft module according to the present invention showing the location of various apertures formed therein.
Figure 4:
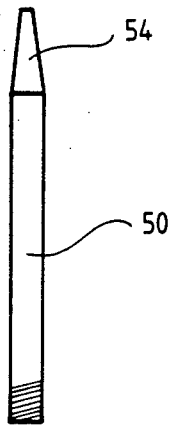
FIG. 4 is a side elevational view of a threaded guide pin for use in aligning adjacent modules during assembly of the elevator shaft shown in FIG. 3.

Assembly of the elevator shaft involves the sequential building of a stack of elevator shaft modules according to the height of elevator shaft required. The individual corner joints are assembled by lowering an upper shaft module 13 over a lower module 12 already secured in place. To assist in locating adjacent modules a guide bar formed as a tapered guide pin 50, as shown in FIG. 4, can be attached to the top of the lower module. A plurality for example three or four, of the guide pins 50 are threaded into suitable threaded apertures 51 formed in an upper edge 52 of a lower module 53 as shown in FIG. 5. The guide pins 50 extend vertically from the lower module 53 with tapered ends 54 uppermost. The guide pins 50 engage with apertures formed in the lower edge of the upper module to guide the upper module progressively to the correct seating as it is lowered.

When the tapered end 54 of each of the guide pins 50 has passed into its corresponding aperture, the horizontal position of the shaft modules relative to one another has been adjusted to within a few millimeters of the required position. Since the diameter of the cylindrical body or shaft portion of each of the guide pins 50 is smaller than the diameter of its corresponding aperture by only a small amount, say three millimeters, further horizontal movement of the modules with respect to one another is prevented. The guide pins thus act as a coarse horizontal position adjustment. Fine adjustment of the horizontal positions of two adjacent modules is effected by the engagement of the ends of the elevator car guide rails (not shown) on the upper and lower modules.

Figure 6:
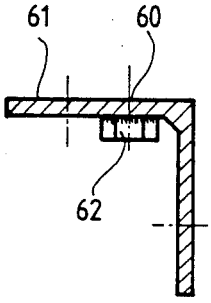
FIG. 6 is a cross sectional side elevational view a retaining bolt aperture formed in an upper shaft module according to the present invention.

On assembly of adjacent modules to form a elevator shaft, once the coarse and fine adjustments of the horizontal relative positions of the modules has been effected as described above, the guide pins are subsequently removed and replaced with retaining bolts inserted downwardly through the upper module to engage the threaded apertures 51 to form an anchorage between the two adjacent modules. A number of apertures 55, similar to the apertures 51, are distributed about the upper surface of lower shaft module 53 to receive further retaining bolts. The retaining bolts can be threaded into apertures such as an aperture 60 formed in a lower flange 61 of an upper module as shown in FIG. 6. The apertures 60 consist of plain apertures having nuts 62 secured, for example by welding, over them to form the threaded portions.

The screw jack bolts 27 are threadably inserted in the nuts 26 prior to fitting an upper module into position to permit leveling and plumbing of the upper shaft module 13 relative to the lower module 12 by virtue of the bolts 27 supporting the module 13 above the module 12. The vertical separation of the two modules is also finally adjusted by means of the bolts 27.

When the two modules are horizontally and vertically aligned, the trough is flooded with resin 25 which supports the upper module on the lower module. When the level of resin is visible at a predetermined height on the inclined section of the weir plate 23, as viewed from inside the shaft module 12, the pouring of the resin is ceased and the resin sets to support the upper module 13 on the lower module 12. The resin 25 supports substantially all of the load formerly borne by the screw jack bolts 27 during adjustment of the shaft module relative positions.

In an alternative embodiment, in which, for example, two or three shafts are assembled adjacent one another by the use of shaft modules having more than one shaft formed therein, bracing members can extend across the top and bottom of the shaft. It will be clear that resin filled joints can be formed at the resulting intersection of a bracing member and a shaft wall, although such a joint will not be located at a corner of the shaft itself.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator shaft comprising:

a generally vertically extending stack of individual, self-supporting, prefabricated shaft modules, each said module having a structural strength sufficient to support the module or modules above thereby permitting supporting of the shaft from a lower one of said modules; and means provided on at least one of adjacent ones of said modules for defining a void between vertically spaced portions of said adjacent modules to contain a fluid material, the void being filled with a structural resin which sets to form a solid bed of resin material supporting and maintaining said vertically spaced portions of said adjacent modules apart.

2. The elevator shaft according to claim 1 including a plurality of beds of resin disposed at spaced locations between said adjacent modules.

3. The elevator shaft according to claim 1 wherein each of said adjacent modules is of generally rectangular cross section and said means for defining the void is provided at each corner of said one module such that, on filling of the voids with structural resin, the upper one of said adjacent modules is supported on the lower one of said adjacent modules in four regions.

4. The elevator shaft according to claim 3 wherein the voids extend to either side of the apex of each of said corners at which each of the voids is located.

5. The elevator shaft according to claim 1 wherein said means for defining a void includes a pair of spaced horizontal surfaces disposed respectively on an upper edge of the lower one of said adjacent modules and a lower edge of the upper one of said adjacent modules, inner, outer and end barrier walls of the void being provided on said upper edge of said lower module.

6. A elevator shaft according to claim 5 wherein said inner barrier wall of the void includes an upstanding plate secured on an inner surface of an upper end of said lower one of said adjacent modules and projecting above an upper edge of said lower module, an upper portion of said plate being inclined, and wherein said outer and end barrier walls of the void include upstanding walls of compressible foam disposed on said upper edge of said lower module and on said inclined upper portion of said plate to define the void.

7. The elevator shaft according to claim 1 including jacking means disposed between said adjacent modules for plumbing and spacing of an upper one of said adjacent modules and a lower one of said adjacent modules relative to one another.

8. The elevator shaft according to claim 7 wherein said jacking means is disposed on said upper module and is positioned to engage said lower module.

9. The elevator shaft according to claim 7 wherein said jacking means includes a plurality of screw jacks disposed between said upper module and said adjacent lower module for adjusting the relative orientation of said two adjacent modules in two mutually perpendicular planes parallel to a longitudinal axis of the elevator shaft and for adjusting the spacing between said adjacent modules.

10. The elevator shaft according to claim 9 wherein said screw jacks each include a nut secured over an aperture formed in a lower horizontal surface of said upper module and a bolt threaded into said nut and passing through said aperture, a free end of said bolt being adapted to contact a horizontal surface on an upper edge of said adjacent lower module, whereby tightening and loosening of said bolt raises and lowers said upper module with respect to said lower shaft module.

11. The elevator shaft according to claim 1 wherein guide means are provided for locating said adjacent upper and lower modules relative to one another during assembly of the elevator shaft.

12. The elevator shaft according to claim 11 wherein said guide means includes a removable guide extending vertically upwardly from said lower module, said guide being engageable with a corresponding aperture formed in a lower edge of said upper module to locate said adjacent modules relative to one another.

13. The elevator shaft according to claim 12 wherein said removable guide includes a vertical shaft having a free upper end which tapers and is engageable with said aperture formed in said upper module, a portion of said shaft having a diameter smaller than a diameter of said aperture by a predetermined amount and being engageable with said aperture to permit horizontal positioning of said adjacent modules relative to one another to within a predetermined tolerance on insertion of said shaft into said aperture.

14. The elevator shaft according to claim 1 wherein a horizontal flange extends outwardly about a lower edge of said upper module and a corresponding horizontal flange extends outwardly about an upper edge of said adjacent lower module, said two flanges, on assembly of the elevator shaft, being aligned with one another and spaced from one another by a region of resin, the space between said flanges unsupported by said resin being at least partly filled by a compressible sealing strip aligned with longitudinal axes of said horizontal flanges.

15. The elevator shaft according to claim 1 including a plurality of anchoring means secured, on assembly of the elevator shaft, between one of said modules and a structure defining a well in which the elevator shaft stands to restrain transverse movement of said shaft module.

16. The elevator shaft according to claim 1 including fire- and smokeproofing means encircling the elevator shaft at the level of each floor of a building in which the shaft stands and including a Z-section retainer plate having an upper horizontal member extending outwardly of the shaft and resting on a floor of the building and a lower horizontal member extending inwardly to intersect the elevator shaft, whereby said retainer plate defines a channel encircling the elevator shaft for receiving a fire- and smokeproof substance.

17. A modular elevator shaft comprising:

at least two adjacent prefabricated shaft modules, each said module having a structural strength sufficient to support a module or modules above thereby permitting supporting of the shaft from a lower one of said modules;

means disposed between said adjacent modules for horizontally and vertically aligning said adjacent modules with respect to one another; and means provided on at least one of said adjacent modules for defining a void between vertically spaced portions of said adjacent modules to contain a fluid material, said void being filled with a structural resin which sets to form a solid bed of resin material supporting and maintaining said vertically spaced portions of said adjacent modules apart.

18. The elevator shaft according to claim 17 wherein said means for horizontally and vertically aligning includes jacking means disposed between said adjacent modules for plumbing and vertically spacing an upper one of said adjacent modules and a lower one of said adjacent modules relative to one another.

19. The elevator shaft according to claim 17 wherein said means for horizontally and vertically aligning includes guide means for locating said adjacent modules horizontally relative to one another during assembly of the elevator shaft.

20. A modular elevator shaft comprising:

a generally vertically extending stack of individual, self-supporting, prefabricated shaft modules, each said module having a structural strength sufficient to support the module or modules above thereby permitting supporting of the shaft from a lower one of said modules;

means disposed between adjacent ones of said modules for horizontally and vertically aligning said adjacent modules with respect to one another; and means provided on said adjacent modules to define a void between vertically spaced portions of said adjacent modules, said void being filled with a structural resin forming a solid bed of resin material supporting and maintaining said vertically spaced portions of said adjacent modules apart.

* * * * *